US009377027B2

(12) United States Patent
Behnke et al.

(10) Patent No.: US 9,377,027 B2
(45) Date of Patent: Jun. 28, 2016

(54) VERTICAL DOUBLE-SUCTION PUMP HAVING BENEFICIAL AXIAL THRUST

(75) Inventors: Paul W. Behnke, Seal Beach, CA (US); Matthew J. Koren, Los Angeles, CA (US)

(73) Assignee: ITT MANUFACTURING ENTERPRISES LLC., Wilmington, DE (US)

( * ) Notice: Subject to any disclaimer, the term of this patent is extended or adjusted under 35 U.S.C. 154(b) by 429 days.

(21) Appl. No.: 13/207,473

(22) Filed: Aug. 11, 2011

(65) Prior Publication Data

US 2013/0039754 A1 Feb. 14, 2013

(51) Int. Cl.
*F04D 29/041* (2006.01)
*F04D 1/00* (2006.01)
*F04D 29/16* (2006.01)

(52) U.S. Cl.
CPC ..... *F04D 29/0416* (2013.01); *F04D 1/006* (2013.01); *F04D 29/167* (2013.01)

(58) Field of Classification Search
CPC ... F04D 1/006; F04D 29/041; F04D 29/0416; F04D 29/2211; F04D 29/2266
USPC ..... 415/104, 106, 98, 99, 101, 102; 416/186 R, 187, 184
See application file for complete search history.

(56) References Cited

U.S. PATENT DOCUMENTS 1,027,624 A * 5/1912 Paulsmeier ..... 415/106
1,045,432 A * 11/1912 Paulsmeier ..... 415/106
1,130,616 A * 3/1915 Lorenz ..... 415/106
1,323,412 A * 12/1919 Schorr ..... 415/104
1,634,317 A * 7/1927 Benson ..... 415/106
1,881,680 A 10/1932 Klosson
1,912,452 A 6/1933 Hollander
1,975,274 A 10/1934 Hollander et al.
2,013,079 A * 9/1935 Slocum ..... 415/170.1
2,287,397 A 6/1942 Rupp
2,358,744 A * 9/1944 Stepanoff ..... 415/97

(Continued)

FOREIGN PATENT DOCUMENTS

CN 201377433 Y * 1/2010
GB 155530 12/1920

(Continued)

OTHER PUBLICATIONS

English Machine Translation CN201377433.*

(Continued)

*Primary Examiner* — Craig Kim
*Assistant Examiner* — Wayne A Lambert

(57) ABSTRACT

Apparatus, including a vertical double-suction pump, is provided featuring a pump casing and a double suction impeller arranged therein on a shaft. The pump casing has a pump casing wall. The double suction impeller has upper and lower shrouds with metal rims configured to form upper and lower isolating annuli between the double suction impeller and the wall of the pump casing in order to impede a recirculation flow from an impeller discharge to be able to act of the upper and lower shrouds and create a controlled axial thrust load from differentiated hydraulic pressure on the upper and lower shrouds. The upper and lower isolating annuli may also be geometrically varied between the upper and lower shrouds of the double suction impeller to create a pressure differential in a direction parallel to an axis of rotation of the double suction impeller.

5 Claims, 4 Drawing Sheets

(56) References Cited

U.S. PATENT DOCUMENTS

| | | | | | |
|---|---|---|---|---|---|
| 2,383,424 | A | * | 8/1945 | Stepanoff | 415/98 |
| 2,504,140 | A | * | 4/1950 | Mill | 222/330 |
| 2,625,110 | A | * | 1/1953 | Haentjens et al. | 417/423.12 |
| 3,123,010 | A | | 3/1964 | Witt et al. | |
| 3,280,750 | A | * | 10/1966 | White | 417/357 |
| 3,457,869 | A | | 7/1969 | Janetz | |
| 3,936,221 | A | | 2/1976 | Lobanoff | |
| 4,406,583 | A | * | 9/1983 | Becker et al. | 415/204 |
| 4,563,124 | A | | 1/1986 | Eskew | |
| D288,325 | S | | 2/1987 | Davis et al. | |
| 4,643,652 | A | * | 2/1987 | Eberhardt | 417/364 |
| 4,782,696 | A | | 11/1988 | Suchoza et al. | |
| 4,830,572 | A | * | 5/1989 | Oklejas et al. | 415/110 |
| 4,867,633 | A | * | 9/1989 | Gravelle | 415/106 |
| 4,893,986 | A | * | 1/1990 | Catterfeld et al. | 415/100 |
| 5,106,262 | A | * | 4/1992 | Oklejas et al. | 415/171.1 |
| 5,141,390 | A | * | 8/1992 | Haentjens | 415/52.1 |
| 5,238,363 | A | | 8/1993 | Thielke et al. | |
| 5,374,129 | A | | 12/1994 | Vohr et al. | |
| 5,456,818 | A | * | 10/1995 | Houston et al. | 205/131 |
| 5,494,403 | A | | 2/1996 | Kobayashi et al. | |
| 5,567,133 | A | | 10/1996 | Kobayashi et al. | |
| 5,857,841 | A | | 1/1999 | Kobayashi et al. | |
| 6,036,435 | A | | 3/2000 | Oklejas | |
| 6,193,462 | B1 | * | 2/2001 | Kubota | 415/106 |
| 6,206,097 | B1 | | 3/2001 | Stephens | |
| 6,264,440 | B1 | * | 7/2001 | Klein et al. | 417/420 |
| 6,565,335 | B1 | | 5/2003 | Yano et al. | |
| 6,619,935 | B1 | * | 9/2003 | Kluth et al. | 417/423.1 |
| 7,648,332 | B2 | * | 1/2010 | Eslinger et al. | 415/106 |
| 7,775,763 | B1 | * | 8/2010 | Johnson et al. | 415/111 |
| 8,568,081 | B2 | * | 10/2013 | Song et al. | 415/1 |
| 2005/0254943 | A1 | * | 11/2005 | Fukuchi et al. | 415/206 |
| 2007/0110595 | A1 | | 5/2007 | Sato et al. | |
| 2007/0116558 | A1 | | 5/2007 | Naruse et al. | |

FOREIGN PATENT DOCUMENTS

| | | |
|---|---|---|
| JP | 6047898 | 3/1985 |
| SU | 979706 | 12/1982 |

OTHER PUBLICATIONS

Hodkiewicz M.R. and Pan J. Identification of Transient Axial vibration on Double-suction Pumps During Partial flow Operation [online], April 200411retrieved on Nov. 20, 2014]. Retrieved from the Internet:< URL: http://www.acoustics.asn.au/journal/2004/2004_32_1_Hodkiewicz_Pan.pdf>.*

SU 979706 A1, Dec. 7, 1982, English Machine Translation, Translated by ProQuest Dialog Apr. 19, 2016.*

JPS6047898 English Language Abstract (2 pages).

SU979706 English translation of the relevant parts.

* cited by examiner

VERTICAL DOUBLE-SUCTION PUMP HAVING BENEFICIAL AXIAL THRUST

BACKGROUND OF THE INVENTION

1. Field of the Invention

The present invention relates to a pump or pumping assembly, arrangement or combination; and more particularly relates to a new technique for providing axial thrust in such a pump or pumping assembly, arrangement or combination, e.g., including a vertical double-suction pump.

2. Brief Description of Related Art

Single-suction type impellers produce hydraulic thrust loads in the direction along their axis of rotation. In a vertically suspended pump, these axial thrust loads are transmitted from the impeller(s) at the bottom of the pump rotor assembly, through the shaft of the pump, and absorbed by a thrust bearing in the motor at the top of the pump. Axial thrust loads are beneficial in vertical pumps for two reasons:

1) Axial thrust loads applied to pump shafts in tension increase the rotor dynamic stiffness of the rotor system.
2) Axial thrust loads applied to pump shafts improve the internal alignment of the pump rotating elements to stationary elements.

Typical double-suction type impellers produce no axial thrust loads from hydraulic forces; because their symmetrical geometry about the centerline of the impeller has the same pressure acting on both shrouds. Therefore, when typical double-suction impellers are used in vertically suspended pumps, the benefits of axial thrust loads pump shafts are not realized, and these types of pumps suffer from poor reliability.

In view of the aforementioned, there is a long felt need in the industrial pump industry for an improved design or technique that solves the problems related to realizing axial thrust loads in an industrial pump or pumping assembly, arrangement or combination, including a vertical double-suction pump.

SUMMARY OF THE INVENTION

According to some embodiments of the present invention, apparatus, including for example a vertical double-suction pump, is provided featuring a pump casing and a double suction impeller arranged therein on a shaft. The pump casing has a pump casing wall. The double suction impeller has upper and lower shrouds with metal rims configured to form upper and lower isolating annuli or rings between the double suction impeller and the pump casing wall of the pump casing in order to impede a recirculation flow from an impeller discharge to be able to act upon the upper and lower shrouds and create a controlled axial thrust load from differentiated hydraulic pressure on the upper and lower shrouds.

In effect, the present invention provides a special double-suction type impeller design, which creates the controlled axial thrust load from differentiated hydraulic forces acting on the impeller shrouds. The metal rims or rings on the upper and lower shrouds of the double-suction impeller design create or form the isolating annuli or rings between the double suction impeller and the pump casing wall. The isolation occurs as a result of the metal rim impeding the recirculation flow from the impeller discharge to be able to act upon the upper and lower impeller shrouds. The upper and lower isolating annuli or rings may be geometrically varied between the upper and lower shrouds of the impeller, which creates a pressure differential in the direction parallel to the axis of impeller rotation. Thus axial thrust load is created on a double-suction impeller design which normally has no substantial hydraulic thrust load in the direction of the axis of rotation.

When this innovative double-suction type impeller design is used in vertically suspended pumps, the benefits are at least as follows:

- Axial thrust loads applied to pump shafts in tension increase the rotor dynamic stiffness of the rotor system and thereby improve pump reliability.
- Axial thrust loads applied to pump shafts in tension improve internal alignment of the pump rotor and casing and thereby improve wear life of bearings and shafts.
- Incorporating a pair of isolating annuli between the impeller and pump casing wall reduces internal leakage in the pump, which improves volumetric efficiency and overall pump efficiency.
- Incorporating a pair of isolating annuli between the impeller and pump casing wall dampens secondary flows from pump casing recirculation and isolates such flows from buffeting the shrouds of the impeller. This mitigates undesirable axial vibration on the pump rotor system.
- The metal ring which makes up the isolation annuli on the impeller is located at the minimum trim value of the impeller outside diameter. This allows the impeller to have a variety of trim diameters without compromising the benefits of the invention.

BRIEF DESCRIPTION OF THE DRAWING

The drawing includes the following Figures, not necessarily drawn to scale.

Figure 1:
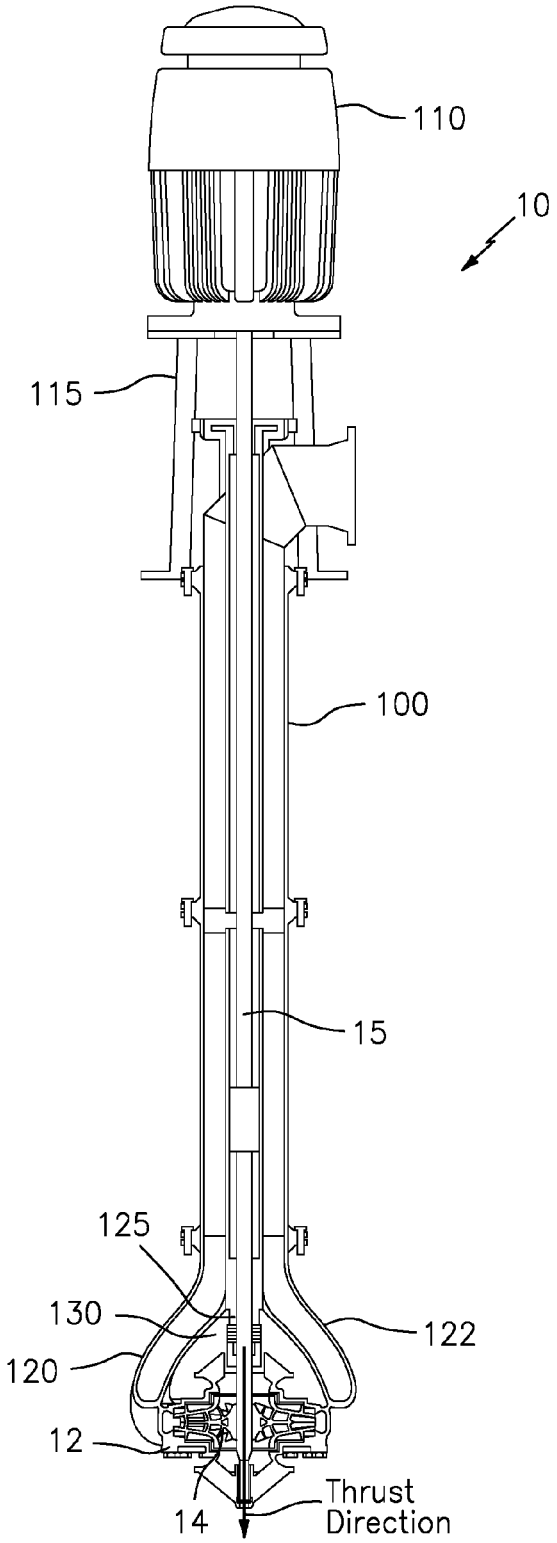
FIG. 1 is a partial cross-sectional view of apparatus in the form of a vertical double-suction pump having beneficial thrust according to some embodiments of the present invention.

In the following description of the exemplary embodiment, reference is made to the accompanying Figures in the drawing, which form a part hereof, and in which is shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIG. 1 shows apparatus generally indicated as 10 according to some embodiments of the present invention in the form of a vertical double-suction pump. While the present invention will be described by way of example in relation to such a vertical double-suction pump, the scope of the invention is not intended to be limited to the type or kind of pump, pumping assembly, arrangement or combination. For example, embodiments are envisioned in which the present invention is implemented in other types or kinds of pumps, pumping assemblies, arrangements or combinations either now known or later developed in the future.

Figure 2:
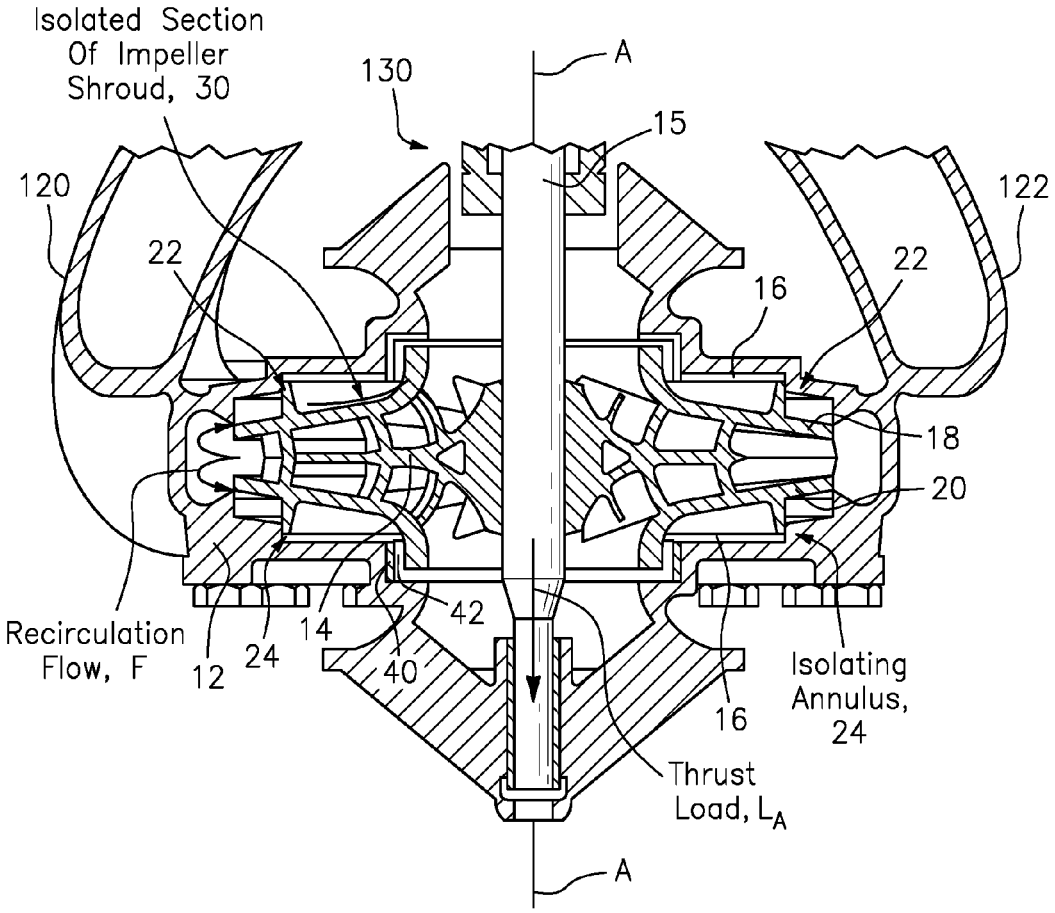
FIG. 2 is a partial cross-sectional view of the lower part of the apparatus shown in FIG. 1.
Figure 3:
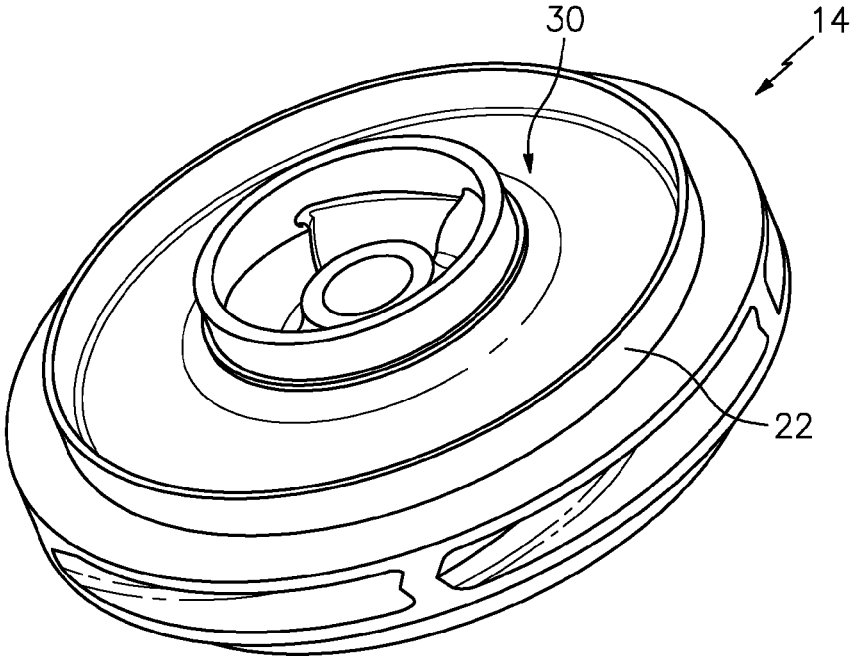
FIG. 3 is a top perspective view of a double suction impeller according to some embodiments of the present invention.

In FIGS. 1 and 2, the vertical double-suction pump 10 includes a pump casing 12 and a double suction impeller 14 (see FIG. 3) arranged therein on a shaft 15. The pump casing 12 has a pump casing wall 16. The double suction impeller 14 has upper and lower shrouds 18 and 20 with metal rims 22 and 24 (also known and referred to herein as "annuli 22, 24" or "isolating annuli 22, 24") configured to form upper and lower isolating annuli between the double suction impeller 14 and the pump casing wall 16 of the pump casing 12 in order to impede a recirculation flow F from the impeller discharge 120, 122 to be able to act upon the upper and lower shrouds 18 and 20, and create a controlled axial thrust load $L_A$ from differentiated hydraulic pressure on the upper and lower shrouds 18 and 20 of the double suction impeller 14 within corresponding isolated sections 30 located above and below the impeller 14. The isolated sections 30 are established by the isolating annuli 22 and 24 and pump wearing rings 40, 42.

In operation, the pair of isolating annuli 22 and 24 between the double suction impeller 14 and pump casing wall 16 reduces internal leakage in the pump 10, which improves volumetric efficiency and overall pump efficiency, and also dampens secondary flows from pump casing recirculation and isolates such flows from buffeting the upper and lower shrouds 18 and 20 of the double suction impeller 14. This mitigates undesirable axial vibration on the overall pump rotor system of the apparatus 10.

According to some embodiments, the upper and lower isolating annuli 22 and 24 may also be geometrically varied between the upper and lower shrouds 18 and 20 of the double suction impeller 14 to create a pressure differential in a direction parallel to an axis A of rotation of the double suction impeller 14.

The upper and lower isolating annuli 22 and 24 may be configured to create the controlled axial thrust load $L_A$ on the double suction impeller 14 which typically has substantially no hydraulic thrust load in the direction of the axis A of rotation.

The upper and lower isolating annuli 22 and 24 may be configured to form an isolated section generally indicated by arrow 30 along the upper or lower shrouds 18 and 20 extending at least partly towards the shaft 15. (In FIG. 2, the isolation section 30 of the upper impeller shroud 18 is identified by the dark line pointed to by arrow 30, and the lower impeller shroud 20 is understood to have a similar isolation section that is configured and formed by the lower isolating annuli 24.

Figure 3A:
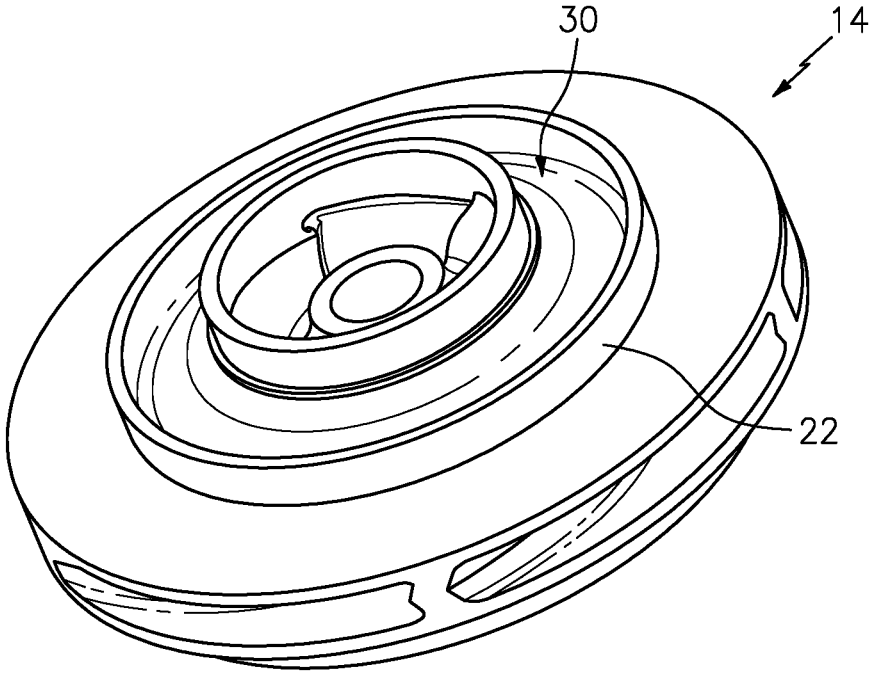
FIG. 3A is a top perspective view of a double suction impeller according to some embodiments of the present invention.

The metal rims 22 and 24 may be configured to be located at a minimum trim value in relation to the outside diameter of the double suction impeller 14, as shown, e.g., in FIG. 2. However, the scope of the invention is not intended to be limited to the specific configuration, height or location of the metal rims 22 and 24 shown in FIG. 2. For example, embodiments are envisioned in which the metal rims 22 and 24 are configured or located on the upper and lower shrouds 18 and 20 at a different location than that shown, e.g., in FIG. 2, including being configured on the upper and lower shrouds 18 and 20 closer to the outside diameter nearer impeller discharges 120, 122, or including being configured on the upper and lower shrouds 18 and 20 closer to its inner periphery nearer the shaft 15 (See FIG. 3A). The metal rims 22 and 24 are configured at a specific location on the upper and lower shrouds 18 and 20 and with a sufficient height so as to impede the recirculation flow F from the impeller discharge 120, 122 to be able to act upon the upper and lower shrouds 18 and 20, and create the controlled axial thrust load $L_A$ from differentiated hydraulic forces on the upper and lower shrouds 18 and 20. As shown, the metal rims 22 and 24 are configured to extend substantially completely around the upper or lower shrouds 18 and 20.

Moreover, the apparatus 10, e.g., as shown in FIGS. 1 and 2, also includes other elements or components that do not form part of the underlying invention described herein, as would be appreciated by a person skilled in the art, and thus are not described in detail herein, including a discharge piping assembly 100, a motor assembly 110 arranged on a motor mounting assembly 115 and coupled to the shaft 15, the impeller discharges 120, 122 coupled between the pump casing 12 and a discharge piping assembly 100, a bellows type mechanical face sealing arrangement arranged between a casing assembly 125 and the shaft 15 and generally indicated by an arrow 130 that forms part of another patent application by the instant inventors, etc.

The Scope Of The Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What we claim is:

1. A vertically suspended double-suction pump (10) comprising:
   - a discharge pipe assembly (100) that extends vertically along a vertical axis (A) of rotation;
   - a motor assembly (110) arranged on a motor mounting assembly (115);
   - impeller discharges (120, 122) coupled to the discharge pipe assembly(100);
   - a pump casing (12) having a pump casing wall (16) and being coupled to the impeller discharges (120, 122);
   - a pump shaft (15) coupled to the motor mounting assembly (115) to rotate on the vertical axis (A) of rotation and configured in the discharge pipe assembly (100) to extend into the pump casing (12) so as to form part of a pump rotor system; and
   - a double suction impeller (14) arranged in the pump casing (12) and coupled to the pump shaft (15), having upper and lower shrouds (18, 20) with metal rims (22, 24) configured to form upper and lower isolating annuli (22, 24) between the double suction impeller (14) and the pump casing wall (16) of the pump casing (12) in order to impede a recirculation flow (F) from the impeller discharges (120, 122) to be able to act upon the upper and lower shrouds (18, 20) so as to dampen secondary flows from pump casing recirculation and isolate such flows from buffing the upper and lower shrouds (18, 20) of the double suction impeller (14) which mitigates undesirable axial vibration on the pump rotor system of the vertically suspended double-suction pump (10), the upper and lower isolating annuli (22, 24) being geometrically varied between the upper and lower shrouds (18, 20) to create a pressure differential in a downward direction parallel to the vertical axis (A) of rotation of the double suction impeller (14) caused from differentiated hydraulic forces on the upper and lower shrouds (18, 20) so as to apply an axial thrust load ($L_A$) to the pump shaft (15) in tension to increase rotor dynamic stiffness in the pump rotor system.

2. The vertically suspended double-suction pump (10) according to claim 1, wherein the metal rims (22, 24) are configured to extend substantially completely around the upper or lower shrouds(18, 20).

3. The vertically suspended double-suction pump (10) according to claim 1, wherein the double suction impeller (14) has an outer diameter, and the metal rims (22, 24) are configured or located on the upper and lower shrouds (18, 20) closer to the outer diameter nearer the impeller discharges (120, 122).

4. The vertically suspended double-suction pump (10) according to claim 1, wherein the double suction impeller (14) has an inner periphery, and the metal rims (22, 24) are configured or located on the upper and lower shrouds (18, 20) closer to the inner periphery nearer the pump shaft (15).

5. The vertically suspended double-suction pump (10) according to claim 1, wherein the metal rims (22, 24) are configured at a specific location on the upper and lower shrouds (18, 20) and with a sufficient height so as to impede the recirculation flow (F) from the impeller discharges (120 ,122) to be able to act upon the upper and lower shrouds (18, 20), and create the axial thrust load ($L_A$) from the differentiated hydraulic forces on the upper and lower shrouds(18, 20).

* * * * *